US006590445B2

(12) United States Patent
Ueda

(10) Patent No.: US 6,590,445 B2
(45) Date of Patent: Jul. 8, 2003

(54) REFERENCE VOLTAGE GENERATION CIRCUIT HAVING REDUCED TEMPERATURE SENSITIVITY, AN OUTPUT ADJUSTING METHOD, AND AN ELECTRICAL POWER SOURCE

(75) Inventor: Naohiro Ueda, Hyougo-ken (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/963,412

(22) Filed: Sep. 27, 2001

(65) Prior Publication Data

US 2002/0060600 A1 May 23, 2002

(30) Foreign Application Priority Data

Sep. 27, 2000 (JP) ..... 2000-294287

(51) Int. Cl.[7] ..... G05F 3/02

(52) U.S. Cl. ..... 327/543; 327/538

(58) Field of Search ..... 327/538, 540, 327/541, 543, 545, 546; 323/312, 313, 314, 315

(56) References Cited

U.S. PATENT DOCUMENTS

| | | | | | |
|---|---|---|---|---|---|
| 4,357,571 | A | * | 11/1982 | Roessler | 323/281 |
| 4,417,263 | A | | 11/1983 | Matsuura | |
| 4,460,978 | A | * | 7/1984 | Jiang et al. | 327/208 |
| 4,677,590 | A | * | 6/1987 | Arakawa | 323/313 |
| 4,851,720 | A | * | 7/1989 | Pathak et al. | 326/49 |
| 5,565,791 | A | * | 10/1996 | Raza | 326/38 |
| 6,091,282 | A | * | 7/2000 | Kim | 327/536 |

* cited by examiner

*Primary Examiner*—Terry D. Cunningham
(74) *Attorney, Agent, or Firm*—Dickstein Shapiro Morin & Oshinsky LLP

(57) ABSTRACT

A reference voltage generation circuit includes a depletion type MOS transistor having a gate connected to a source and functioning as a constant current source. At least two enhancement type MOS transistors are connected to the depletion type MOS transistor, and have different threshold voltages, but substantially the same profiles of channel impurities. A pair of floating gate and control gate may be provided in one of the two enhancement type MOS transistors. One of the thresholds is determined by a difference in a coupling coefficient calculated from an area ratio of the floating gate and control gate to a channel so as to avoid fluctuations in performance of the MOS transistors due to temperature.

48 Claims, 15 Drawing Sheets

REFERENCE VOLTAGE GENERATION CIRCUIT HAVING REDUCED TEMPERATURE SENSITIVITY, AN OUTPUT ADJUSTING METHOD, AND AN ELECTRICAL POWER SOURCE

CROSS REFERENCE TO A RELATED APPLICATION

This application claims priority under 35 USC §119 to Japanese Patent Application No. 2000-294287 filed on Sep. 27, 2000, the entire contents of which are incorporated herein by reference.

FIELD OF THE INVENTION

The present invention generally relates to an electrical power source apparatus for use in a small instrument such as a mobile phone, and in particular to a CMOS (Complementary Metal Oxide Semiconductor) inclusion reference voltage generation circuit used alone or built in another semiconductor apparatus, a method for adjusting its output value, and an electrical power source that applies such a reference voltage generation circuit.

BACKGROUND OF THE INVENTION

A reference voltage generation circuit that employs a depletion type MOS transistor whose gate is connected to a source as a constant current source has been known as described for example in Japanese Patent Application Laid Open No. 04-65546. In such a description, as demonstrated in FIG. 9, a constant current characteristic is utilized while connecting the gate to the source in a depletion type MOS transistor Q1. In addition, a plurality of enhancement type MOS transistors Q12 and Q13, each having a gate and a drain connected to each other, is serially connected to be driven by the constant current. Then, voltages generated in these MOS transistors Q12 and Q13 can be taken out as reference voltages. Any one of such MOS transistors Q1, Q12, and Q13 are of an n-channel type. Voltages (Vgs) between the gate and source of the MOS transistors Q12 and Q13 are $V_0$12 and $V_0$13, respectively. Only one or two or more MOS transistors Q12 and Q13 can be employed as demonstrated in FIG. 9.

In such a circuit, the threshold voltages of respective enhancement type MOS transistors Q12 and Q13 are differentiated from each other. However, as a manner of differentiating threshold voltages among the depletion type MOS transistor Q1 and the enhancement between the MOS transistor Q12 and/or Q13, it is described that impurity density of either a base plate or a channel is changed as an example. Such a manner is performed by changing an infusion value when an ion is infused.

Another reference voltage generation circuit that promises a depletion type MOS transistor whose gate is connected to a constant current source is demonstrated in FIG. 10. The legend Q1 indicates a depletion type MOS transistor that is the same as described in FIG. 9. The legend Q2 indicates an enhancement type MOS transistor whose threshold voltage is lower (i.e., threshold voltage Vth(low)). The legend Q3 indicates an enhancement type MOS transistor whose threshold voltage is higher (i.e., threshold voltage Vth(high)). As a reference voltage (VREF), a difference between threshold voltages of respective enhancement type MOS transistors Q2 and Q3 is output.

FIG. 11 demonstrates a plurality of relations between the (Vgs) and the $(Ids)^{1/2}$ of the MOS transistors Q1, Q2, and Q3 of the reference voltage generation circuit illustrated in FIG. 10 using signals under a condition that a drain voltage is saturated. In the above, it is premised that all of conductance factors (K) of the respective MOS transistors Q1, Q2, and Q3, are the same and the legend "Vgs" represents a voltage between a gate and a source. In addition, the legend "Ids" represents a drain current.

Since the Vgs of the MOS transistors Q1 is fixed to zero volts, a constant current "Iconst" is carried in accordance with the legend Q1 of FIG. 11. Accordingly, respective "Vgs" of the MOS transistors Q2 and Q3 wherein the Ids becomes the Iconst (Ids=Iconst) amount to $V_0$2 and $V_0$3. Since the reference voltage VREF is represented by this difference, the following formulas are established:

$$VREF = V_0\mathbf{3} - V_0\mathbf{2} = Vth(\text{high}) - Vth(\text{low})$$

Accordingly, it can be understood therefrom that the reference voltage VREF can be represented by the difference between threshold voltages Vth(high) and Vth(low) of the pair of the MOS transistors Q2 and Q3.

A reference voltage VREF formed by such a circuit configuration has the following advantages. Since the reference voltage is determined by a difference between threshold voltages Vth, unevenness of the reference voltage VREF is smaller than a change in a constant current caused by unevenness of threshold voltage Vth of the depletion type MOS transistor. Second, since temperature characteristics of the MOS transistors Q2 and Q3 are substantially the same, sensitivity of the reference voltage VREF to temperature is small. Third, when comparing with a band gap reference circuit, since at least three MOS transistors are enough to constitute a reference voltage generation circuit, the reference voltage generation circuit can readily be configured within a relatively small area. The band gap reference circuit is a device that takes out a reference voltage VREF having an extraordinary small temperature coefficient by utilizing a difference in polarity of temperature performance between a voltage (Vbe: a voltage between a base and an emitter) of a PN connection type and a thermal voltage Vt. The thermal voltage Vt should be obtained by dividing KT into (q) (i.e., kT/q), wherein (k) represents a Boltzman constant, (T) represents an absolute temperature, and (q) represents a unit of electricity.

However, even by the circuit configuration of FIG. 10, there exists the following problems when achieving a reference voltage VREF having higher precision. First, since ion infusion determines respective threshold voltages Vth of MOS transistors Q2 and Q3, these unevenness are independent from each other, and the difference therebetween becomes larger. As a result, unevenness of the reference voltage VREF becomes larger. FIG. 12 demonstrates an example when the threshold Vth of the MOS transistor Q2 becomes low and that of the MOS transistor Q3 becomes high, wherein each of dotted lines represents a status before a change.

Second, since respective channel impurity profiles are different from each other, respective threshold voltages Vth and temperature performances of mobility are different from each other in a strict sense. As a result, there is a limit on improvement in a temperature performance of the reference voltage VREF. FIG. 13 demonstrates another example when temperature is high and the threshold voltages Vth and the mobilities of the MOS transistors Q2 and Q3 are changed. The dotted line therein represents a condition before a change. As noted therefrom, inclination varies.

Third, when describing a conventional process of a semiconductor apparatus provided with a reference voltage generation circuit with reference to FIG. 14, a well is formed on a wafer (in step S22) after that wafer is set (in step S21), and an element separation coat is then formed on the wafer surface (in step S23). Some ions are infused in an element area so as to determine a threshold voltage Vth, thereby a reference voltage VREF is determined (in step S24). After forming a gate electrode on the surface of the wafer (in step S25), and the source and drain on the element area (in step S26), an insulating coat (e.g. a polysilicon-metal insulating coat) is formed between a poly-silicon and a metal wiring (in step S27). Then, one or more contact holes are formed on the poly-metal insulating coat (in step S28). After forming a metal wiring on the polysilicon-metal insulating coat (in step S29), a passivation coat is formed (in step S30). A wafer test is then performed (in step S31), and a package is sealed, thereby a semiconductor apparatus is completed (in step S32).

However, in such a conventional reference voltage generation circuit, since the reference voltage VREF is determined by the threshold voltage Vth, when an ion infusion process that determines the threshold voltage Vth (refer to FIG. 14 and step S4) is over, the reference voltage VREF can not be changed. In addition, since such an ion infusion process is performed in the first half section of a manufacturing process of the semiconductor apparatus, a lot of time elapses from determination of the reference voltage VREF (i.e., specification determination) to completion of the semiconductor apparatus.

SUMMARY OF THE INVENTION

Accordingly, an object of the present invention is to address and resolve the above and other problems and provide a new reference voltage generation circuit. The above and other objects are achieved according to the present invention by providing a novel reference voltage generation circuit, that includes a depletion type MOS transistor configured to include a gate connected to a source and to function as a constant current source. At least two enhancement type MOS transistors may serially be connected to the depletion type MOS transistor and have different threshold voltages as well as substantially the same profiles of channel impurities. A pair of a floating gate and a control gate is provided in at least one of two enhancement type MOS transistors. One of the threshold voltages is determined by a difference in a coupling coefficient calculated from an area ratio of the floating gate and control gate to a channel of the enhancement type MOS transistors. In addition, one of the floating gate and control gate of the enhancement type MOS transistors includes at least one fuse circuit at an optional portion other than a channel region.

In another embodiment, the control gate includes a plurality of fuse circuits serially arranged.

In yet another embodiment, the control gate includes a plurality of fuse circuits arrange in parallel.

In yet another embodiment, at least one fuse circuit is arranged at a laminate portion of the floating gate and the control gate.

In yet another embodiment, at least one fuse circuit is arranged at a portion of the control gate, where the floating gate is not laminated.

In yet another embodiment, at least one fuse circuit is arranged at a portion of the floating gate, where the control gate is not laminated.

In yet another embodiment, an electrical power source apparatus includes a detection circuit configured to compare an electrical power source voltage with a reference voltage so as to display and control the electrical power source voltage. The reference voltage is set by the reference voltage generation circuit.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein:

FIG. 9 is a chart for illustrating one example of a reference voltage generation circuit that premises a depletion type MOS transistor as a constant current source and the present invention is applied to;

FIG. 10 is a chart for illustrating another example of a reference voltage generation circuit that premises a depletion type MOS transistor as a constant current source and the present invention is applied to;

DETAILED DESCRIPTION OF THE PREFERRED EMBODIMENTS

Figure 9:
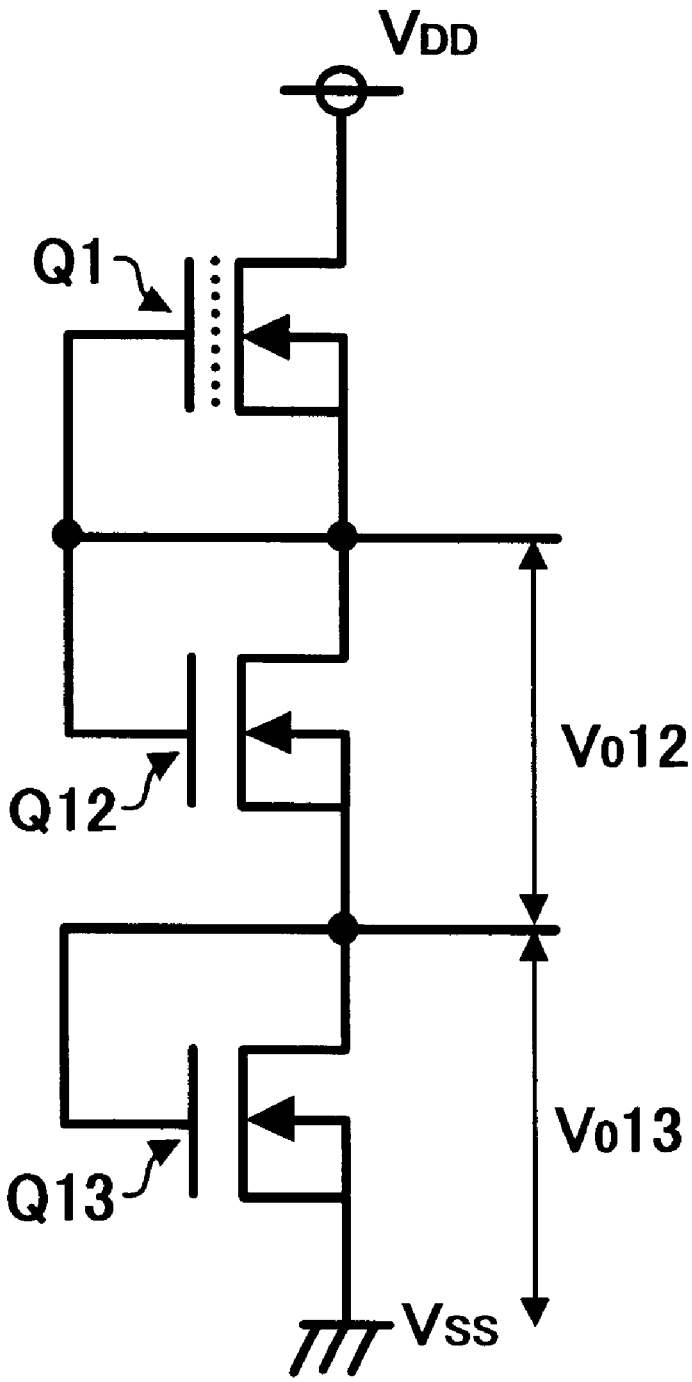
FIG. 9 BACKGROUND ART
Figure 10:
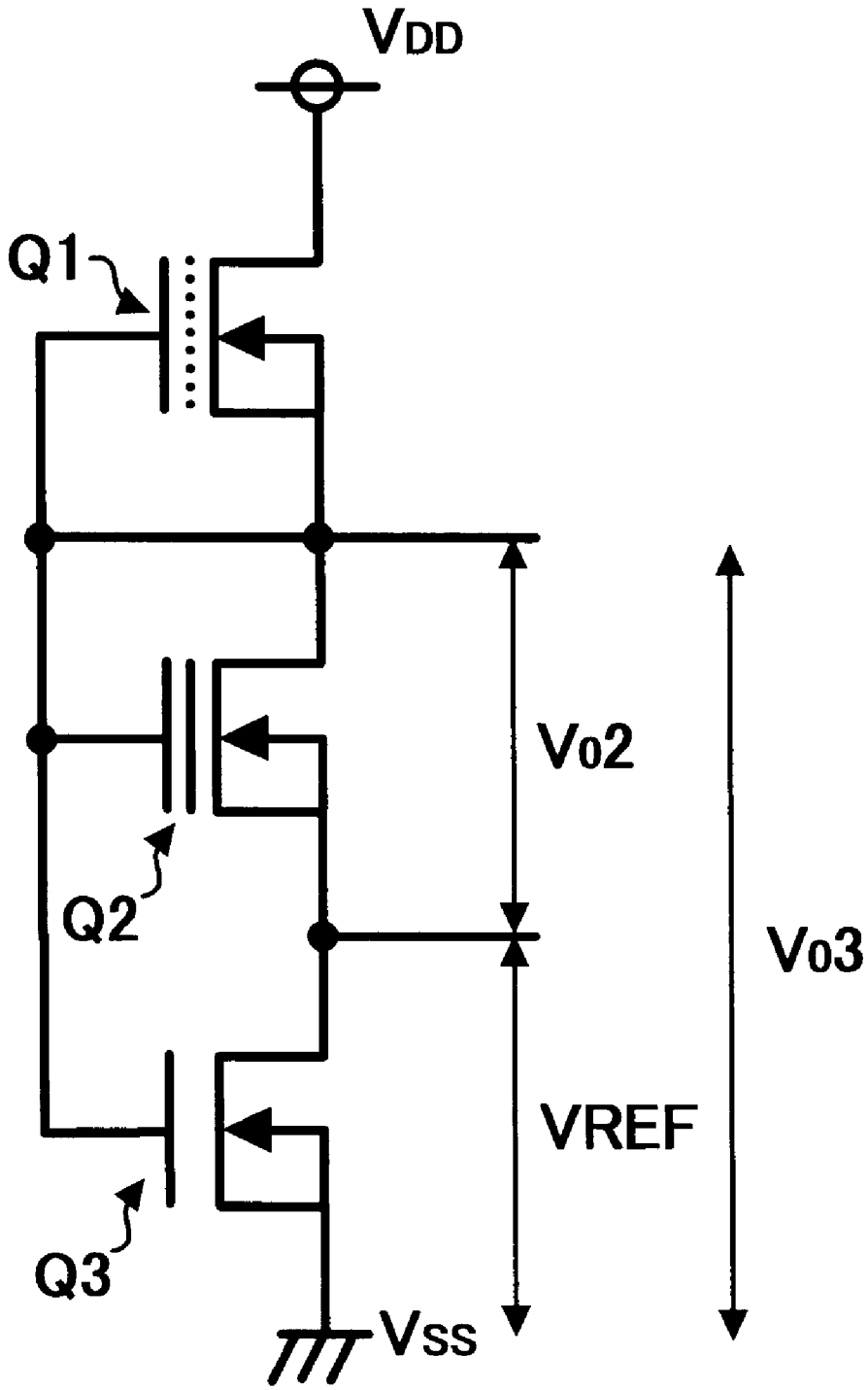
Figure 11:
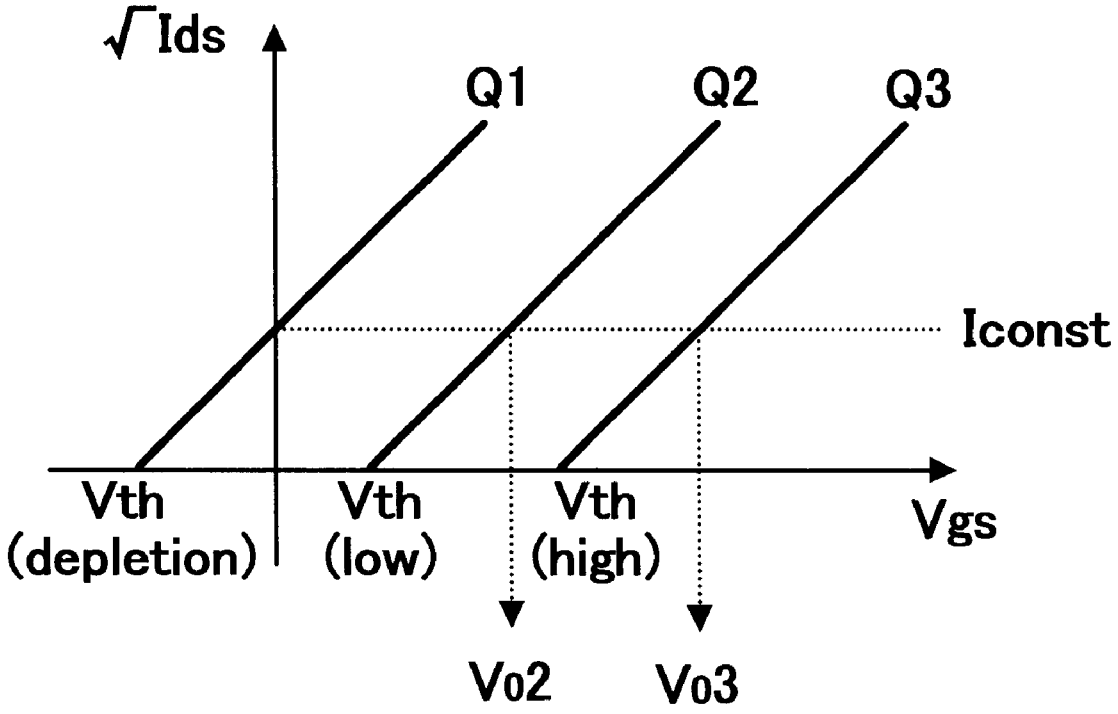
FIG. 11 is a chart for illustrating a plurality of waves each showing a relation between Vgs and $(Ids)^{1/2}$ of MOS transistors whose drain voltages meet saturate conditions.
Figure 12:
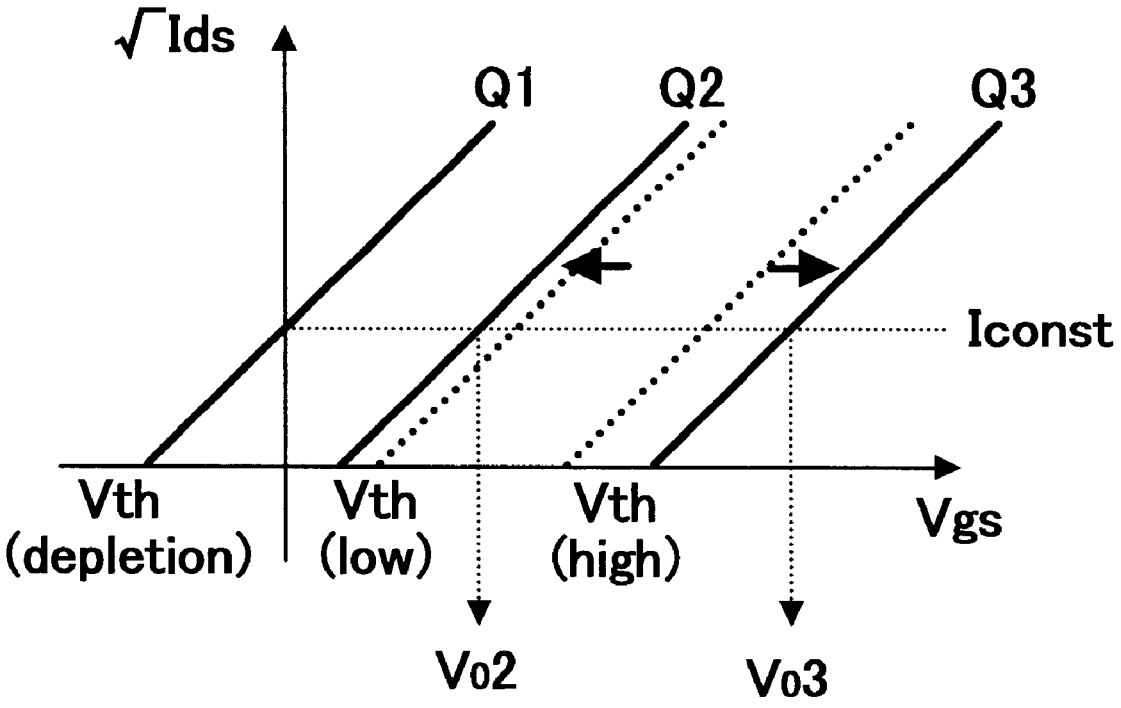
FIG. 12 is a chart for illustrating a plurality of waves each showing a relation between Vgs and $(Ids)^{1/2}$ when threshold voltages of MOS transistors Q2 and Q3 are changed.
Figure 13:
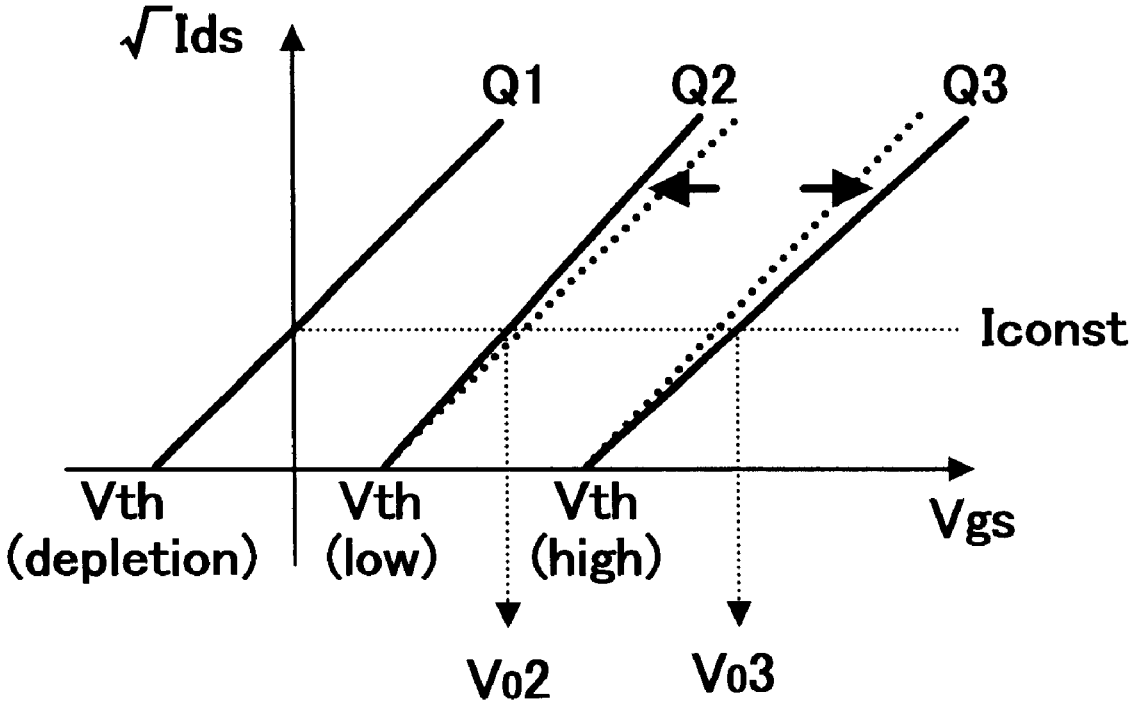
FIG. 13 is a chart for illustrating a plurality of waves each showing a relation between Vgs and $(Ids)^{1/2}$ when temperature is high, and threshold voltages and respective mobility of MOS transistors Q2 and Q3 are changed.
Figure 15:
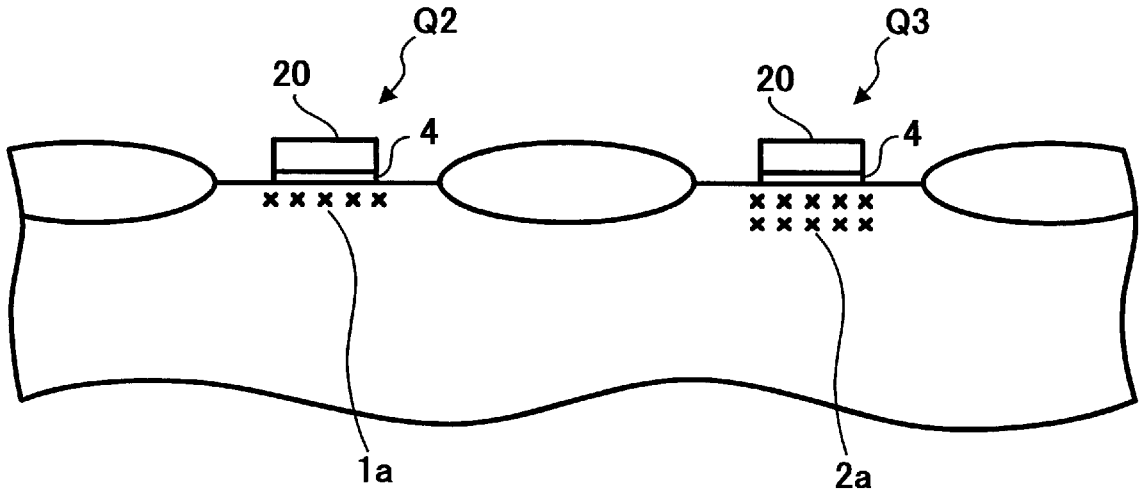
FIG. 15 is a cross sectional view for illustrating an n-channel type MOS transistor having different threshold voltages Vth and provided in a conventional reference voltage generation circuit.

Referring now to the drawings, like reference numerals designate identical or corresponding parts throughout several views. Several embodiments of reference voltage generation circuits according to the present invention may be similar to those demonstrated in FIGS. 9 and 10 or modifications thereof. For comparison purposes, a cross section of an n-channel type MOS transistor included in the conventional reference voltage generation circuit and having different threshold voltages Vth is demonstrated in FIG. 15. To have legends correspond to those described in the circuit of FIG. 10, the legend Q2 is assigned to the MOS transistor whose threshold voltage Vth is lower, and the legend Q3 is assigned to that having a higher threshold. A process illustrated therein may be just after poly-silicon gate formation.

The legends 1*a* and 2*a* may represent respective channel dope areas. The legend X represents infused boron. The numeral 20 represents a poly-silicon gate. The numeral 4 represents a gate oxide coat. The boron of the channel dope is infused more in the MOS transistor Q3, and the threshold value Vth becomes higher by this rate. By changing an amount of the boron, an impurity profile in the channel region is differentiated. In addition, such a difference may cause unevenness of the above-described process such as the ion infusion and sensitivity of the temperature performance.

Figure 1A:
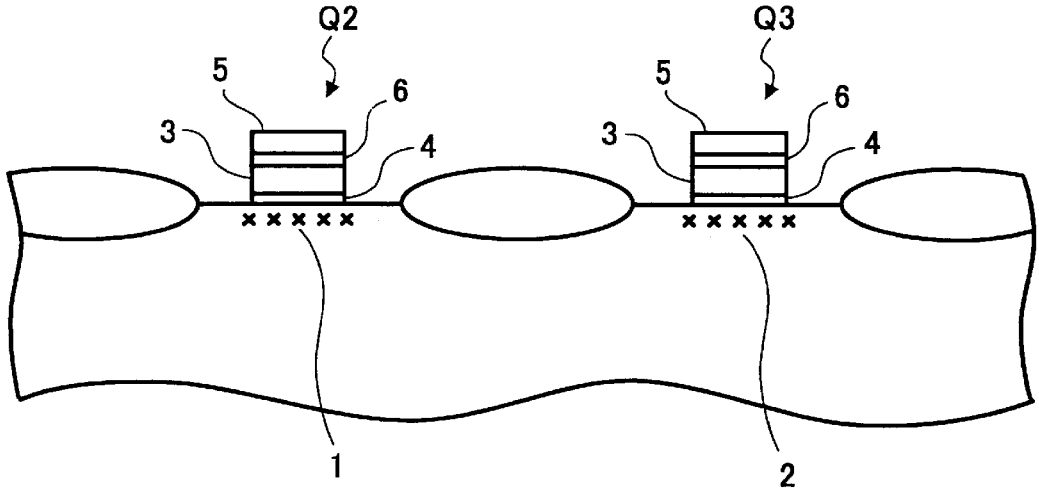
FIG. 1A is a schematic cross sectional view for illustrating a semiconductor apparatus of the first embodiment according to the present invention.
Figure 1B:
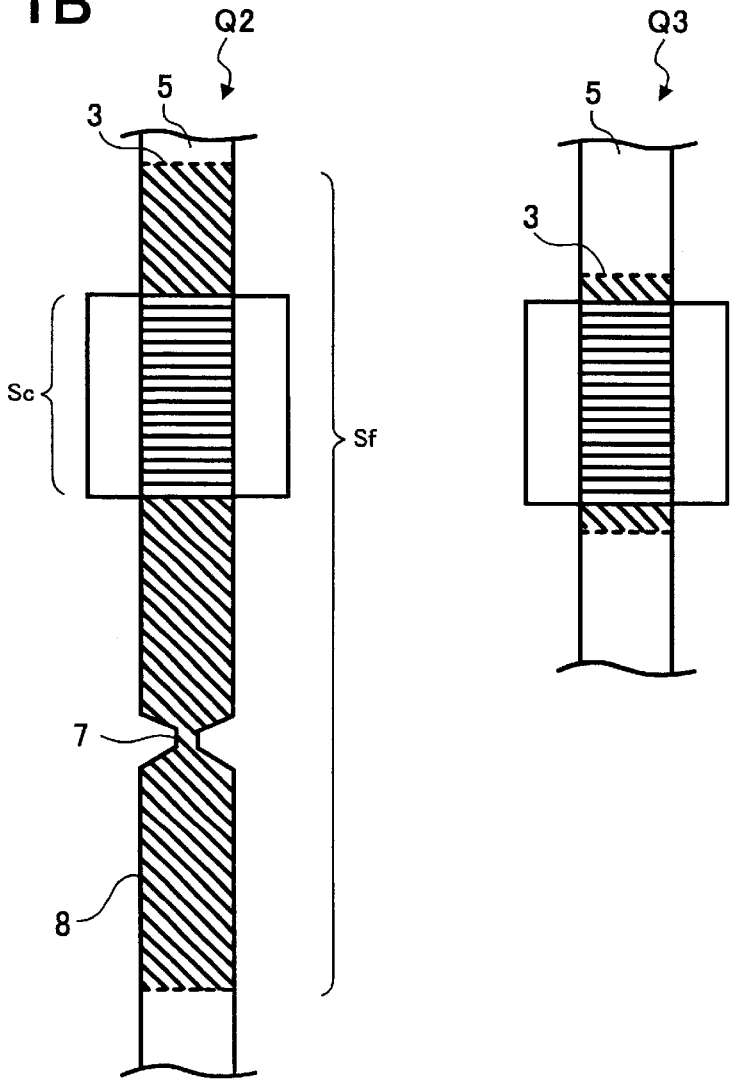
FIG. 1B is a schematic plan view for illustrating the semiconductor apparatus illustrated in FIG. 1A.

FIGS. 1A and 1B demonstrate the first embodiment of the present invention and include a cross sectional view in the upper side and a plan view in the lower side. Each of the numbers 1, 2 and 4 may indicate the same device to that having the legends 1*a*, 2*a* and 4 described in FIG. 15. However, respective channel impurities of the channel dope areas 1 and 2 may be different from those illustrated in FIG. 15. Specifically, these channel impurity may simultaneously be formed and have the same profile.

The numeral 5 indicates a control gate made of poly-silicon. The control gate may be formed on a floating gate 3, which is formed on a gate oxide coat 4 and made of poly-silicon, via the coat 6 formed between poly-silicon and the poly-silicon layer (poly/poly layers sandwich coat). In a MOS transistor Q2, a laminate gate electrode, which is formed by the floating gate 3, the poly/poly layers sandwich coat 6, and a control gate 5, may be formed with its width being narrower at a portion other than the channel region. Specifically, such a portion may constitute a fuse circuit 7.

A ratio of the area "Sf" in which the sum of the floating gate 3 and the control gate 5 arc laminated (indicated by side and slash lines, respectively, in FIGS. 1B and 2) to the channel area "Sc" that is indicated by side lines and may be defined as a coupling coefficient (CC). Specifically, the following formula is established:

$$CC=Sf/Sc$$

As demonstrated in FIGS. 1A and 1B of the plan view, the MOS transistors Q2 and Q3 may be different from each other in all of the area Sf that is an overlapping portion of the floating and control gates 3 and 5, the coupling coefficient, and accordingly the threshold voltages Vth. Since a difference in a threshold voltage Vth between the MOS transistors Q2 and Q3 is caused only by a difference in the coupling coefficient, the difference between threshold voltages Vth can be maintained constant even though a coat thickness of each of the channel dope, the gate oxide coat 4, and the poly/poly layers sandwich coat 6 is uneven.

An example is now described using specific numerical value data. When premising a two layer poly-silicon gate MOS transistor as a MOS transistor equivalent to a single layer poly-silicon gate, and representing a capacity of the single layer poly-silicon gate by the legend "Cox_eff", that of a lower layer gate by the legend "Cox-gate", and that of a poly/poly layers sandwich coat of an upper layer by the legend "Cox_psps", a thickness of a gate oxide coat (i.e., a thickness of a poly/ploy layers sandwich coat) by the legend "d", and a gate oxide coat dielectric constant (i.e., a dielectric constant of a poly/poly layers sandwich oxide coat) by the legend " ", the following formulas are established:

$$\begin{aligned} 1/\text{Cox_eff} &= 1/\text{Cox_gate} + 1/\text{Cox_psps} \\ &= (d/\ )(1/Sc + 1/Sf) \\ &= (d/\ )(1/Sc + 1/(CC \times Sc)) \\ &= (d/\ )(1/Sc)(1 + 1/CC) \end{aligned}$$

The above-described appropriate value may be assigned to the following formula defining Vth:

$$\begin{aligned} Vth &= Vfb + 2f + Qb/\text{Cox_eff} \\ &= Vfb + 2f + Qb \times (d/\ )(1/Sc)(1 + 1/CC) \end{aligned}$$

In the above, the legend "Vfb" represents a flat band voltage. The code "f" represents a fermi potential difference. The sum of "Vfb+2 f" is a constant value. The code "Qb" represents an electric charge per a unit area in a depletion layer.

When the sum of "Vfb+2 f" is 0.3V, the following formula is established:

$$Vth=0.3+Qb\times(d/\ )(1/Sc)(1+1/CC)$$

By noticing the third item of the formula (i.e., 1+1/CC), it can be understood therefrom that the threshold voltage Vth is changed when the coupling coefficient is changed.

How much the threshold voltage Vth can change when the coupling coefficient is practically changed is for example calculated as described below. Specifically, when Vth is 1.0 V, "Sc" is 2.0 $\mu m^2$, "Sf" is 2.4 $\mu m^2$, and "CC" is 2.4/2.0 (i.e., 1.2) as to the Q3, and "Sc" is 2.0 $\mu m^2$, "Sf" is 8.0 $\mu m^2$, and "CC" is 8.0/2.0 (i.e., 4.0) as to the Q2, the respective Vth can be calculated as follows:

*Vth* of the Q3=1.0 V

*Vth* of the Q2=0.78 V

As a result, a difference in the respective Vth is 0.22V and output as a reference voltage VREF.

According to the first embodiment, a reference voltage VREF can be output while avoiding influence of unevenness of an ion infusion amount and/or an oxide coat thickness. In addition, since channel impurity profiles of the MOS transistors Q2 and Q3 are simultaneously formed in the same process, the channel impurity profiles and temperature performances of both of mobility and threshold voltage Vth are substantially the same. Thus, owing to such a method, a fine precision reference voltage generation circuit having small temperature sensitivity can be obtained when compared with the conventional type.

As is apparent from the definition formula, the coupling coefficient CC is determined from a ratio of an overlapping area of a floating gate and a control gate to a channel area. In this respect, since the area rate is determined by a mask pattern for a product, once a mask is manufactured, the area rate is constant and hardly changed. If the area rate is changed, the mask must be reformed resulting in extra labor, time, and cost.

However, according to the embodiment of FIG. 1, since the coupling coefficient can be changed by cutting the fuse circuit 7 during the manufacturing process, adjustment of the VREF is possible even after forming the mask, and thereby capable of suppressing waste such as reformation of the mask.

Figure 2:
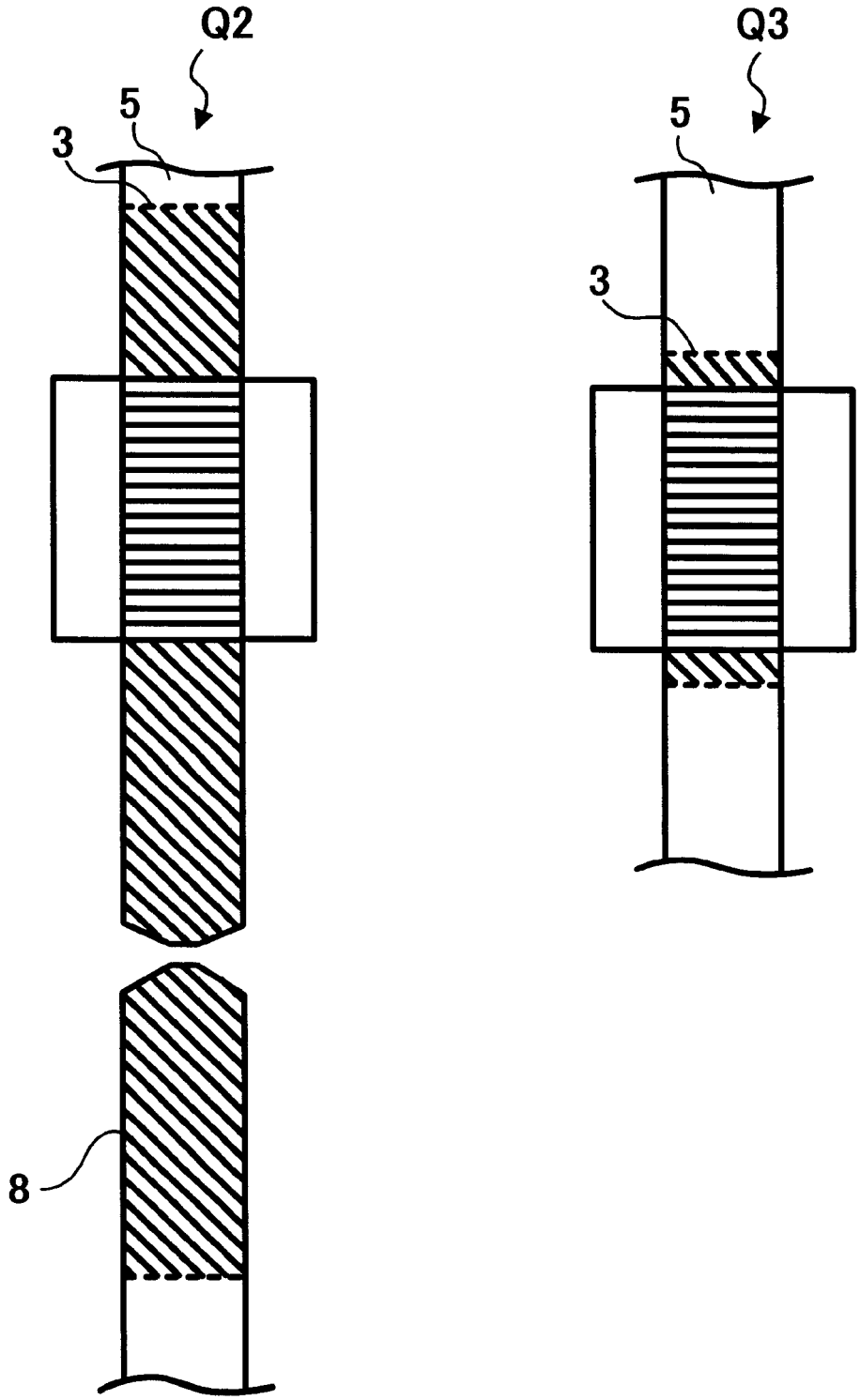
FIG. 2 is a schematic plan view for illustrating a condition of the semiconductor apparatus of the first embodiment after a fuse circuit is cut.

FIG. 2 is a plan view for illustrating a condition after the fuse circuit 7 of the embodiment of FIG. 1 is cut. Since the laminate gate electrode 8 portion does not function as a gate electrode when the fuse circuit 7 is cut, the coupling coefficient becomes smaller than before. Thus, the reference voltage VREF can be changed. For example, "Sc" is 2.0 $\mu m^2$, "Sf" is 8.0 $\mu m^2$, and "CC" is 8.0/2.0 (i.e., 4.0) before cutting, the threshold voltage Vth can be calculated using the above-described conditions as they are as follows:

$$Vth=0.78V$$

When changing the coupling coefficient "CC" to 3.0 by cutting the fuse circuit 7, the threshold voltage is obtained as follows:

$$Vth=0.81V$$

Thus, the threshold voltage, and accordingly the reference voltage VREF can be changed by 0.03V. Of course, when the coupling coefficient "CC" is increased, an obtainable adjustable level of the VREF can be larger.

Figure 3:
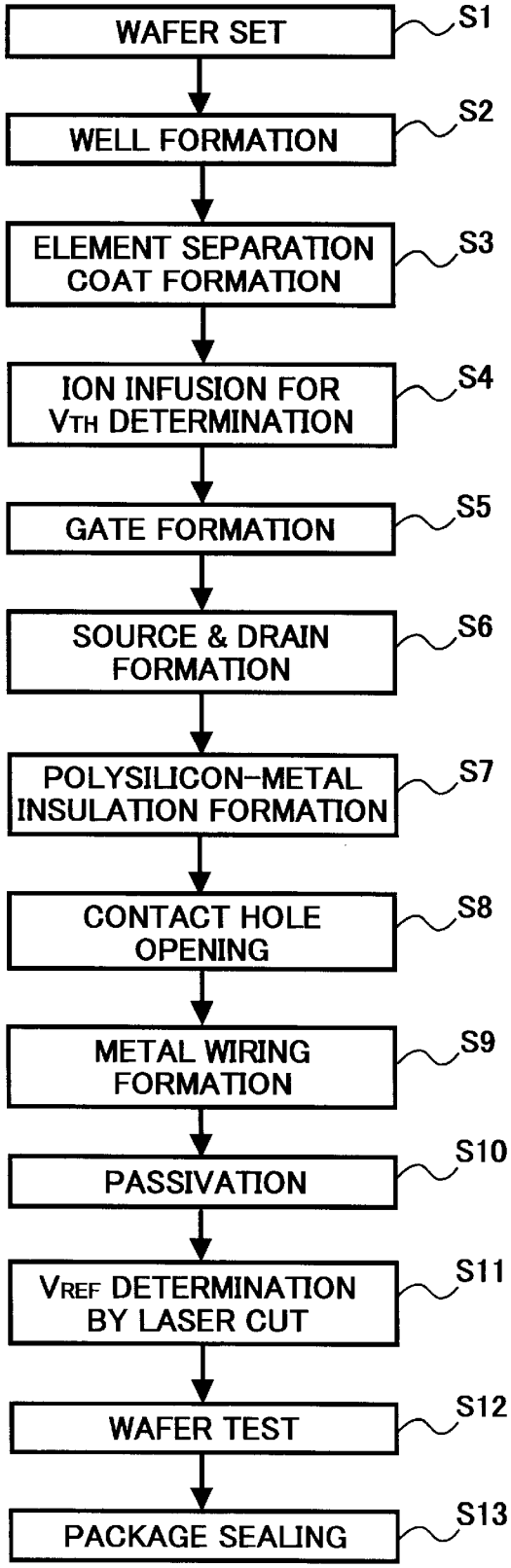
FIG. 3 is a flow diagram for illustrating a process for manufacturing the semiconductor apparatus of the first embodiment.
Figure 14:
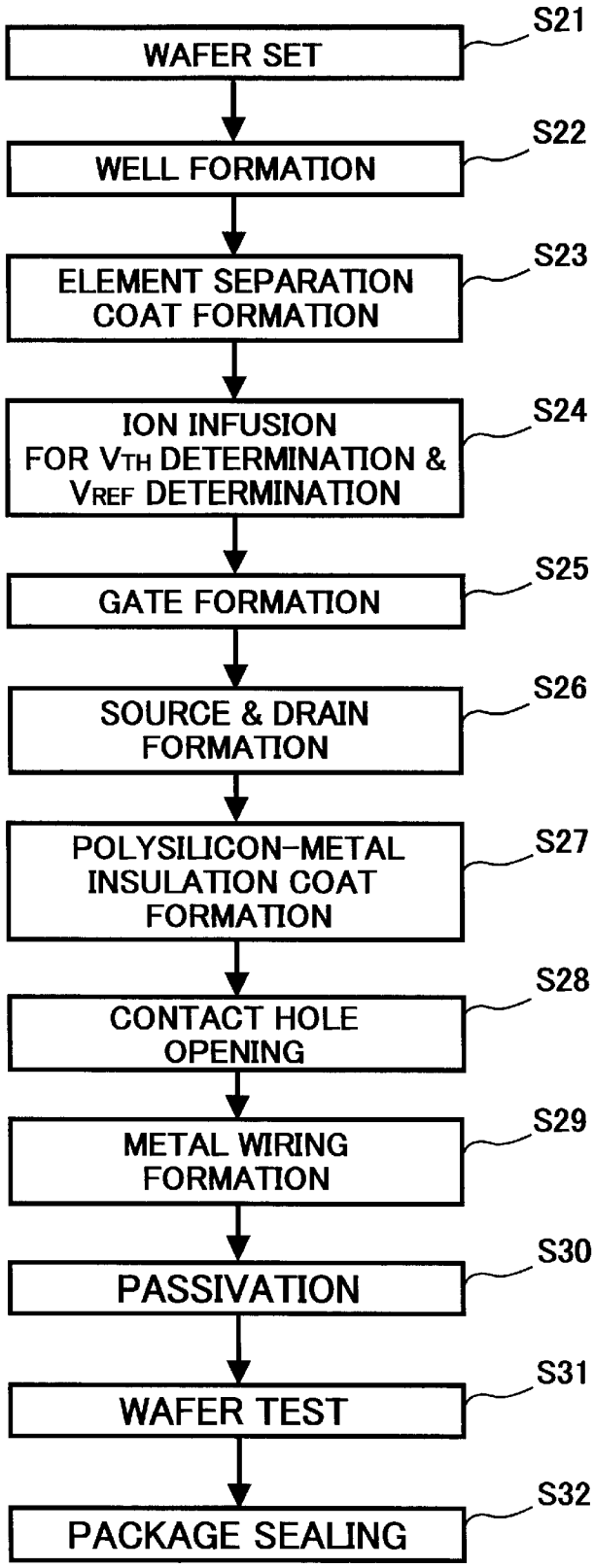
FIG. 14 is a flow diagram for illustrating a conventional semiconductor manufacturing process.

FIG. 3 is a flow diagram for illustrating a process of this embodiment. Descriptions of steps from S1 to S10 are omitted, because they are substantially the same as those described in the flow diagram of FIG. 14. However, an ion infusion process in step S4 does not necessarily determine a reference voltage VREF. In step S10, after forming a passivation coat, a fuse circuit constituting a gate electrode of a MOS transistor forming a reference voltage generation circuit is cut by a laser. Thereby, the coupling coefficient "CC" of the gate electrode is changed and a reference voltage "VREF" of the reference voltage generation circuit is determined (in step S11). However, when a prescribed reference voltage "VREF" exists before cutting the fuse circuit, the fuse circuit 14 is not cut. Then, a wafer test is performed (in step S12) and a package is sealed, thereby completing a semiconductor apparatus (in step S13).

The cutting of the fuse circuit of step S11 may be achieved by using a laser cutting apparatus. In addition, since such a laser cutting process is generally performed right before the wafer test (in step S12), the reference voltage VREF can be changed even in the end portion of the semiconductor apparatus manufacturing process. In other words, the manufacturing time from determination of the reference voltage VREF to completion of the semiconductor apparatus can be minimized according to the present invention.

In addition, according to the present invention, a plurality of reference voltage generation circuits having different reference voltages VREF can be formed by preparing a plurality of fuse circuits and changing only a laser cut portion even using and performing the same mask and process, respectively. These embodiments are demonstrated as a second embodiment in FIG. 4.

Figure 4:
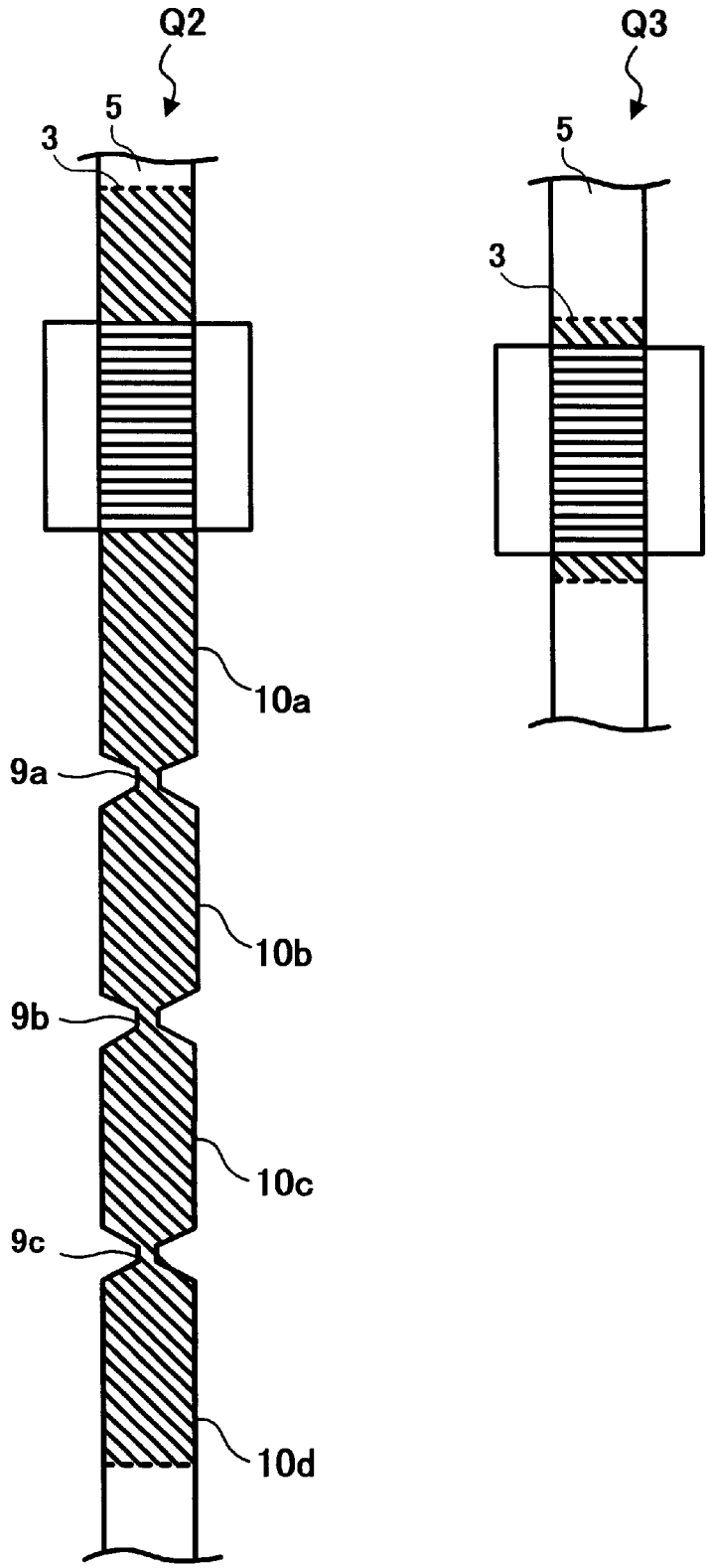
FIG. 4 is a schematic plan view for illustrating a semiconductor apparatus of the second embodiment according to the present invention.

FIG. 4 is a plan view for illustrating the second embodiment in which three-fuse circuits are employed. A cross sectional configuration of FIG. 4 is similar to that of the first embodiment of FIG. 1, and similar thereto, a side line area represents a channel area, and the sum of side and orthogonal ('/') line areas represent an overlapping area of a floating gate and a control gate.

In a MOS transistor Q2, a laminate gate electrode formed by all of a floating gate, a poly/poly layers sandwich coat, and a control gate is formed with its width being smaller at three optional sections other than a channel region. Specifically, these sections may constitute fuse circuits 9*a,* 9*b,* and 9*c*. A laminate gate electrode portion extending until the fuse circuit may be indicated by the-legend 10*a*. A laminate gate electrode portion between the fuse circuits 9*a* and 9*b* may be indicated by the legend 10*b*. A laminate gate electrode portion between the fuse circuits 9*b* and 9*c* may be indicated by the legend 10*c*. A laminate gate electrode portion from the fuse circuits 9*c* may be indicated by the legend 10*c*.

When the fuse circuit 9*c* is cut, the laminate gate electrode 10*d* is separated and does not function as a gate electrode. As a result, a coupling coefficient "CC" of the laminate gate electrode including a channel area is changed. Similarly, when the fuse circuit 9*b* is cut, the laminate gate electrodes 10*c* and 10*d* do not function as gate electrodes. Also, when the fuse circuit 9*a* is cut, the laminate gate electrodes 10*b,* 10*c,* and 10*d* do not function as a gate electrode. Since the coupling coefficient "CC" of the laminate gate electrode including the channel area is changed in accordance with a cut portion of the fuse circuit, a plurality of reference voltage generation circuits having different reference voltages VREF can be manufactured even using and performing the same mask and process.

In the second embodiment, a plurality of fuse circuits is serially connected in relation to a gate electrode. An advantage of this example is that a cutting operation is simple because only one section is enough to be cut by a laser. However, a reference voltage VREF can not be finely adjusted in such a case. Then, a third embodiment may be directed to improve such a disadvantage as illustrated in FIG. 5.

Figure 5:
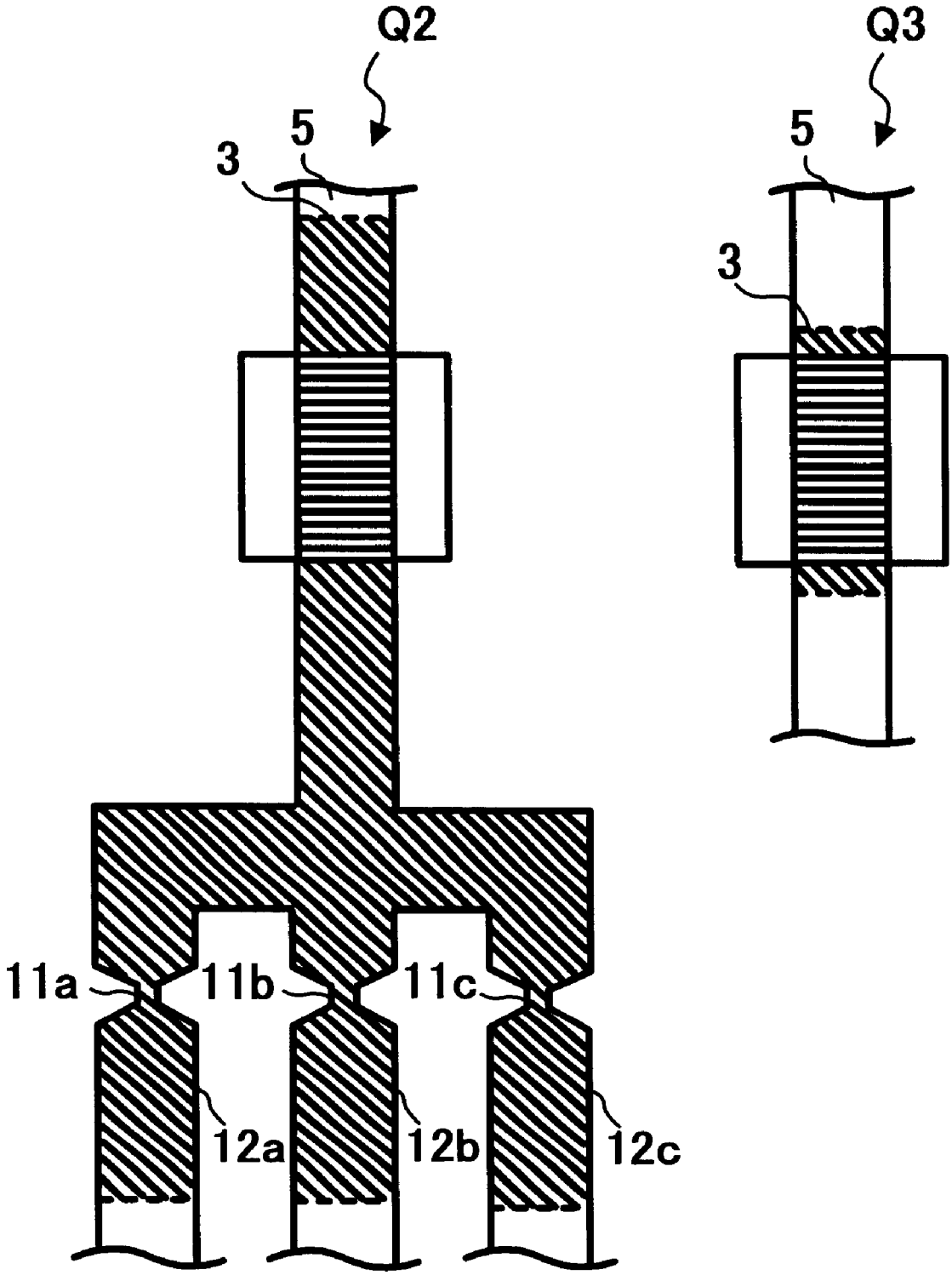
FIG. 5 is a schematic plan view for illustrating a semiconductor apparatus of the third embodiment according to the present invention.

FIG. 5 is a plan view for illustrating the third embodiment. In the third embodiment, a plurality of fuse circuits is connected in parallel in relation to a laminate gate electrode including a channel area. FIG. 5 demonstrates an example where three fuse circuits are employed. A cross sectional configuration may be the same as in the first embodiment of FIG. 1. Also in FIG. 5, similar to the embodiment of FIG. 1, a sideline section indicates a channel area, and the sum of a side and orthogonal line sections indicates an overlapping portion of a floating gate and a control gate.

In a MOS transistor Q2, a laminate gate electrode consisting of a floating gate, a poly/poly layers sandwich coat, and a control gate may be separated into three separation gate electrodes 12*a,* 12*b* and 12*c* at optional portions other than the channel region. The laminate gate electrode may have small widths at each of the three separation gate electrodes 12*a,* 12*b* and 12*c* so as to form fuse circuits. Each of codes 11*a,* 11*b,* and 11*c* may be assigned to respective three fuse circuits formed on the separation gate electrodes 12*a,* 12*b,* and 12*c,* correspondingly.

In such an example, as combinations of cutting portions of the fuse circuits 11*a,* 11*b,* and 11*c,* FIG. 5 shows eight combinations which can be selected, thereby capable of obtaining fine adjustment of the reference voltage VREF. Specifically, when the mark "X" represents cutting, and the mark "–" represents non-cutting, the following eight combinations are possible:

| 11a | 11b | 11c |
|---|---|---|
| — | — | — |
| — | — | X |
| — | X | — |

-continued

| 11a | 11b | 11c |
|---|---|---|
| — | X | X |
| X | — | — |
| X | — | X |
| X | X | — |
| X | X | X |

In the above-described first to third embodiments, the floating gate, the poly/poly layers sandwich coat and the control gate collectively constitutes the fuse circuit. As an advantage of such a configuration, a low cost is exemplified, because the gate electrode is obtained by patterning with a single sheet mask. However, since the fuse circuit unavoidably becomes such a laminate configuration, there is a problem of difficulty in cutting the fuse when compared with a single layer configuration on the other hand.

Figure 6:
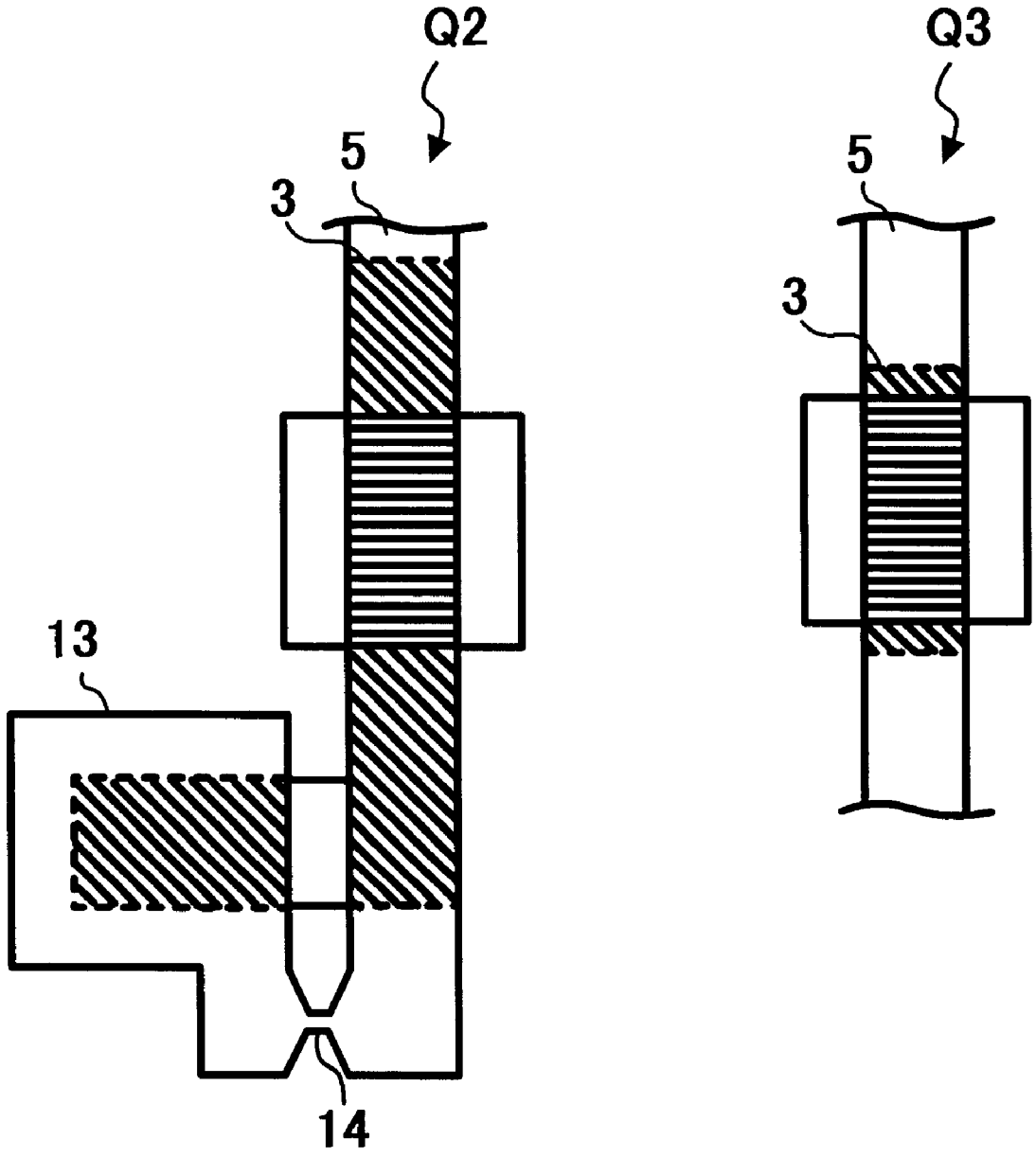
FIG. 6 is a schematic plan view for illustrating a semiconductor apparatus of the fourth embodiment according to the present invention.

Then, the fourth embodiment is provided and makes a fuse circuit into a single configuration with a control gate as demonstrated in FIG. 6. FIG. 6 is a plan view for demonstrating the fourth embodiment. A cross sectional configuration is substantially the same as in the first embodiment. Also in FIG. 6, similar to FIG. 1, a side line section indicates a channel area, and the sum of side and orthogonal line sections indicates an overlapping section by a floating gate and a control gate.

In a MOS transistor Q2, a floating gate, a poly/poly layers sandwich coat, and a control gate collectively constitutes a laminate gate electrode. The floating gate and the control gate are not laminated at a section other than the channel area, and laminated again at the laminate gate electrode 13. A fuse circuit 14 is formed at a portion where the floating gate and the control gate are not overlapped with its width being narrow. A coupling coefficient "CC" of the laminate gate electrode is determined from the overlapping area of the floating and control gates including that at the laminate gate electrode 13.

In FIG. 6, by cutting the fuse circuit 14, the control gate of the laminate gate electrode 13 is separated, and the overlapping area of the floating and control gates is minimized so as to change a coupling coefficient of the laminate gate electrode. By making the fuse circuit 14 into a simplex layer configuration with the control gate, a cutting operation for the fuse circuit becomes easier when compared with a case when cutting a laminate layer configuration of the fuse circuit.

Figure 7:
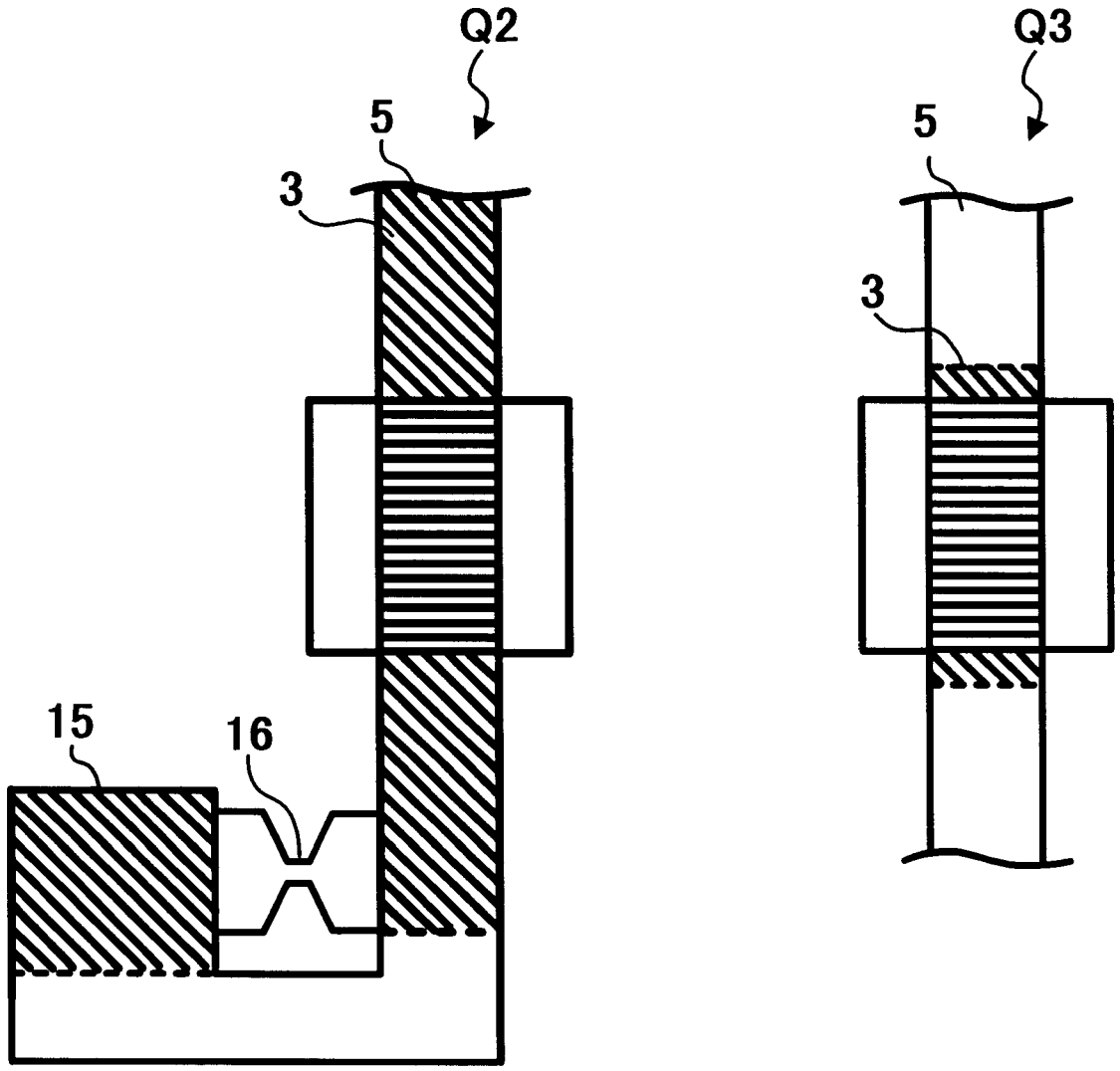
FIG. 7 is a schematic plan view for illustrating a semiconductor apparatus of the fifth embodiment according to the present invention.

Generally, a control gate is commonly used with another gate electrode, and prescribed limits exist on a coat thickness and a resistance. As a result, a cutting performance of a fuse circuit is sometimes sacrificed. Then, the fifth embodiment is provided and makes a fuse circuit into a single configuration with a floating gate as demonstrated in FIG. 7. FIG. 7 is a plan view for demonstrating the fifth embodiment. A cross sectional configuration is substantially the same as in the first embodiment of FIG. 1. Also in FIG. 7, similar to FIG. 1, a side line section indicates a channel area, and the sum of side and orthogonal line areas indicates an overlapping areas of the floating and control gates.

In a MOS transistor Q2, a laminate gate electrode may be consisted by a floating gate, a poly/poly layers sandwich coat, and a control gate. At a section other than a channel region, the control gate and the floating gate are not laminated and laminated again at a laminate gate electrode 15. At a section of the floating gate where the control gate is not laminated, a fuse circuit 16 may be formed with its width being smaller. A coupling coefficient "CC" of the laminate gate electrode may be determined from an overlapping area of the floating and control gates including that at the laminate gate electrode 15.

In FIG. 7, by cutting the fuse circuit 16, the floating gate of the laminate gate electrode 15 is separated, and the overlapping area of the floating and control gates is minimized. Thereby, the coupling coefficient "CC" of the laminate gate electrode can be changed. Since, different from a case for the control gate, a coat thickness or the like of the floating gate can optionally be set, and a manufacturing condition appropriate for fuse cutting can be selected. As a result, a reference voltage generation circuit having an excellent fuse cutting performance can be obtained.

In the above-described first to fifth embodiments, the control gates are positioned above the floating gate. However, the control gates can be positioned below the floating gate. Further, a diffusion layer formed by infusing an impurity to a semiconductor base plate can be used as the control gate. Further, when patterning both of the control and floating gates with a single sheet mask, the two gates overlap on a plane projection diagram thereof. In this respect, in the above-described embodiments, one of them is illustrated as projecting, because the gates are more easily recognized. Thus, these representations do not closely represent the actual practical forms after patterning.

In addition, the overlapping area "Sf" of the floating and control gates are demonstrated in a plane in the above-described embodiments in view of illustration by the drawing, side surface portions of those may contribute to an electrical capacity in the strict sense. Thus, a prescribed configuration that positively utilizes an electrical capacity of the side portions can be employed. In addition, for the purpose of simplification the above-described embodiment premises that the thickness "d" of the gate oxide coat equals to that of the poly/poly layers sandwich coat, and the dielectric constant " " of the gate oxide coat equals to that of the poly/poly layers sandwich oxide coat. However, these relations can be different.

Further, even though the laser beam cuts the fuse circuit in the above-described embodiments, another technique can be utilized for cutting. In addition, even though three fuses are described as an example that employs a plurality of fuse circuit either in parallel or serial in the above-described embodiments, two or more than four fuses can be employed.

In addition, even though an example where the fuse circuit is a single layer configuration of either the control or floating gate, the present invention is not limited to single-layer embodiments. Specifically, it can be understood as a single layer configuration when compared with a laminate configuration of both of the floating and control gates. In other words, it is possible that an insulating coat such as an oxide coat can be positioned either at an upper or lower layer of the control or floating gate. Otherwise, either the control or floating gate itself can be configured from a plurality of laminates.

Figure 8:
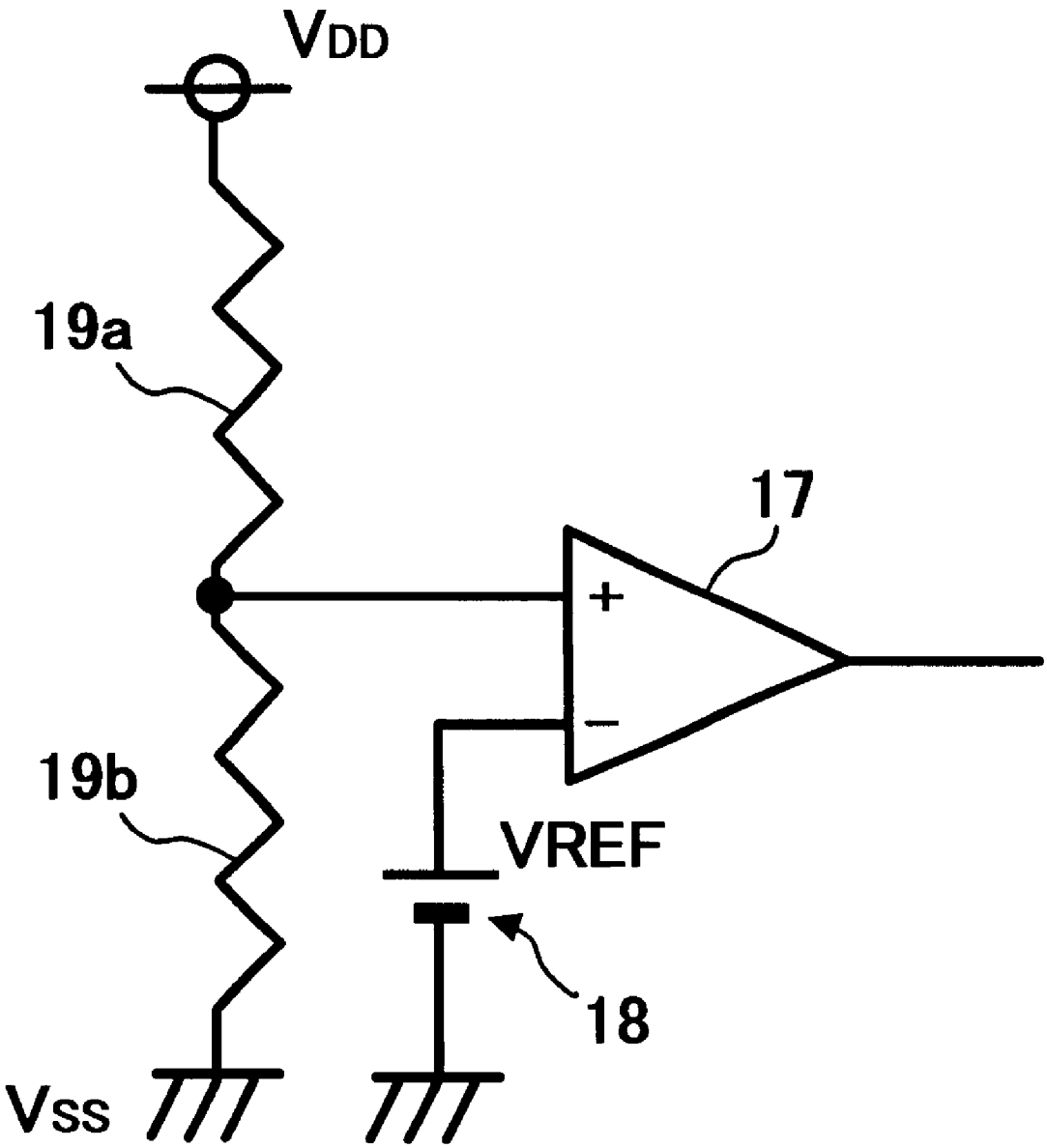
FIG. 8 is a chart for illustrating a detection circuit portion provided in one example of an electrical power source according to the present invention.

FIG. 8 demonstrates an example of an electrical power source provided with a reference voltage generation circuit according to the present invention. The electrical power source may be utilized in a mobile instrument such as a mobile phone and is provided with a detection circuit that detects both of increase and decrease in a voltage VDD of the electrical power source by comparing a supplying electrical power voltage VDD with the reference voltage VREF.

A circuit demonstrated in FIG. 8 may be a detection circuit portion in the electrical power source apparatus. The numerical number 17 denotes a comparator whose reverse input terminal is connected to the reference voltage generation circuit 19 according to the present invention and thus the reference voltage VREF is applied to. An output voltage of a battery as the electrical power source may be applied to the electrical power source VDD terminal, and is then divided by voltage divider resistances 19*a* and 19*b,* and finally input to an non-reverse input terminal of the comparator 17. The reference voltage generation circuit 18 employed may be that demonstrated either in FIGS. 9 or 10, for example. As an electrical power source VDD therefor, a battery of the electrical power source apparatus may be used. Thus, the comparator 17, the reference voltage generation circuit 18, and the voltage divider resistances 19*a* and 19*b* may collectively constitute the detection circuit.

In this electrical power source apparatus, when a battery voltage is high and accordingly a voltage divided by the voltage divider resistances 19*a* and 19*b* is higher than that of the reference voltage VREF, an output voltage of the comparator 17 maintains a high level. In contrast, when the battery voltage is decreased, and accordingly the voltage divided by the voltage divider resistances 19*a* and 19*b* is less than that of the reference voltage VREF, the output voltage of the comparator 17 becomes a low level. In any case, by indicating the output of the comparator on an operating instrument such as the mobile phone, the effect that the voltage of the battery becomes less than the prescribed level can be notified.

Accordingly, if providing a plurality of such detection circuits and differentiating a voltage level detected by each of detection circuits such as by mutually differentiating any one of a reference voltage VREF and a division ratio of the voltage dividing resistors 19*a* and 19*b,* a voltage condition of the battery can be indicated in more detail. The detection circuit portion of FIG. 8 may also be utilized so as to maintain an output voltage of the electrical power source apparatus using the output of the comparator. An apparatus or an instrument that the reference voltage generation circuit of the present invention is applied to is not limited to the above-described electrical power source apparatus. Specifically, the reference voltage generation circuit can be applied to any apparatus or instrument that requires a stable reference voltage.

The mechanisms and processes set forth in the present invention may be implemented using one or more conventional general purpose microprocessors and/or signal processors programmed according to the teachings in the present specification as will be appreciated by those skilled in the relevant arts. Appropriate software coding can readily be prepared by skilled programmers based on the teachings of the present disclosure, as will also be apparent to those skilled in the relevant arts. However, as will be readily apparent to those skilled in the art, the present invention also may be implemented by the preparation of application-specific integrated circuits by interconnecting an appropriate network of conventional component circuits or by a combination thereof with one or more conventional general purpose microprocessors and/or signal processors programmed accordingly. The present invention thus also includes a computer-based product which may be hosted on a storage medium and include, but is not limited to, any type of disk including floppy disks, optical disks, CD-ROMs, magnet-optical disks, ROMs, RAMs, EPROMs, EEPROMs, flash memory, magnetic or optical cards, or any type of media suitable for storing electronic instructions.

Numerous additional modifications and variations of the present invention are possible in light of the above teachings. Accordingly, the invention is not limited by the foregoing description, but is only limited by the scope of the appended claims.

What is claimed as new and desired to be secured by Letters Patent of the United States is:

1. A reference voltage generation circuit, comprising:

a depletion type MOS transistor configured to function as a constant current source;

at least two enhancement type MOS transistors serially connected to the depletion type MOS transistor and having different threshold voltages, at least one of said at least two enhancement type MOS transistors including a floating gate, and control gates of said at least two enhancement type MOS transistors coupled to the depletion type MOS transistor;

wherein one of said threshold voltages is determined substantially from an area ratio of laminates of the floating gate and control gate to a channel, and a reference voltage is provided at an output at one of said enhancement type MOS transistors.

2. The reference voltage generation circuit according to claim 1, wherein said reference voltage is output from the connection between said enhancement type MOS transistors.

3. The reference voltage generation circuit, according to claim 1, wherein said reference voltage is output as a difference between each of said threshold voltages.

4. The reference voltage generation circuit according to claim 1, wherein said constant current source further comprises connecting a gate to a source of one of said the depletion type MOS transistors.

5. The reference voltage generation circuit according to claim 1, wherein said enhancement type MOS transistors have substantially the same channel impurity profiles.

6. The reference voltage generation circuit according to any one of claims 1 to 5, wherein said control gate includes one or more cutting sections at an portion other than said channel, and said cutting sections are serially arranged.

7. The reference voltage generation circuit according to any one of claims 1 to 5, wherein said control gate includes one or more cutting sections at an portion other than said channel, and said cutting sections are arranged in parallel.

8. The reference voltage generation circuit according to any one of claims 1 to 5, wherein said at least one cutting section is arranged on a portion of the laminates of the floating gate and the control gate other than a channel impurity region.

9. The reference voltage generation circuit according to any one of claims 1 to 5, wherein said at least one cutting section is arranged at a portion of the control gate where the floating gate is not laminated.

10. The reference voltage generation circuit according to any one of claims 1 to 5, wherein said at least one cutting section is arranged at a portion of the floating gate where the control gate is not laminated.

11. The reference voltage generation circuit according to claim 6, wherein said cutting section includes a fuse circuit.

12. The reference voltage generation circuit according to claim 7, wherein said cutting section includes a fuse circuit.

13. The reference voltage generation circuit according to claim 8, wherein said cutting section includes a fuse circuit.

14. The reference voltage generation circuit according to claim 9, wherein said cutting section includes a fuse circuit.

15. A method for generating a reference voltage, comprising the steps of:

providing a depletion type MOS transistor functioning as a constant current source;

serially connecting at least two enhancement type MOS transistors to the depletion type MOS transistor, at least one of said at least two enhancement type MOS transistors having a floating gate, and a control gate of each of said at least two enhancement type MOS transistors responsive to the depletion type MOS transistor;

providing substantially the same impurity profiles to channels of the at least two enhancement type MOS transistors;

differentiating threshold voltages of the at least two enhancement type MOS transistors; and determining one of said threshold voltages by a difference in a coupling coefficient calculated from an area ratio of laminates of the floating gate and control gate to the channel.

16. The method according to claim 15, further comprising:

using a difference between the threshold voltages as a reference voltage.

17. The method according to claim 16, further comprising:

forming at least one fuse gate at an portion of any one of the floating gate and control gate other than a channel region; and adjusting the coupling coefficient by cutting any one of fuse gates.

18. The method according to claim 17, wherein said cutting in the step of adjusting the coupling coefficient is performed after a passivation process is completed.

19. An electrical power circuit, comprising:

a depletion type MOS transistor configured to function as a constant current source;

at least two enhancement type MOS transistors serially connected to the depletion type MOS transistor and having different threshold voltages, at least one of said at least two enhancement type MOS transistors including a floating gate, and control gates of said at least two enhancement type MOS transistors coupled to the depletion type MOS transistor;

wherein one of said threshold voltages is determined substantially from an area ratio of laminates of the floating gate and control gate to a channel, and a reference voltage is provided at an output at one of said enhancement type MOS transistors;

a comparing circuit configured to compare a voltage of an electrical power source with said reference voltage; and a control gate configured to control an output of the electrical power source to be constant in accordance with the comparison result, wherein said reference voltage is set by a reference voltage generation circuit.

20. The electrical power circuit according to claim 19, wherein a gate of one of said MOS transistors is connected to a drain of another of said MOS transistors, and said reference voltage is output from the connection between said enhancement type MOS transistors.

21. The electrical power circuit, according to claim 19, wherein said reference voltage is output as a difference between each of said threshold voltages.

22. The electrical power circuit according to claim 19, wherein said constant current source further comprises connecting a gate to a source of one of said depletion type MOS transistors.

23. The electrical power circuit according to claim 19, wherein said enhancement type MOS transistors have substantially the same channel impurity profiles.

24. The electrical power circuit according to any one of claims 19 to 23, wherein said control gate includes at least one cutting section at an portion other than said channel, and said cutting section is serially arranged.

25. The electrical power circuit according to any one of claims 19 to 23, wherein said control gate includes at least one cutting section at an portion other than said channel, and said cutting section is arranged in parallel.

26. The electrical power circuit according to any one of claims 19 to 23, wherein said at least one cutting section is arranged on a portion of the laminates of the floating gate and the control gate other than a channel impurity region.

27. The electrical power circuit according to any one of claims 19 to 23, wherein said at least one cutting section is arranged at a portion of the control gate where the floating gate is not laminated.

28. The electrical power circuit according to any one of claims 19 to 23, wherein said at least one cutting section is arranged at a portion of the floating gate where the control gate is not laminated.

29. The electrical power circuit according to claim 24, wherein said at least one cutting section includes a fuse circuit.

30. The electrical power circuit according to claim 25, wherein said at least one cutting section includes a fuse circuit.

31. The electrical power circuit according to claim 26, wherein said at least one cutting section includes a fuse circuit.

32. The electrical power circuit according to claim 27, wherein said at least one cutting section includes a fuse circuit.

33. A reference voltage generation circuit for use in a mobile telephone, comprising:

a depletion type MOS transistor configured to function as a constant current source;

at least two enhancement type MOS transistors serially connected to the depletion type MOS transistor and having different threshold voltages, at least one of said at least two enhancement type MOS transistors including a floating gate, and control gates of said at least two enhancement type MOS transistors coupled to the depletion type MOS transistor;

wherein one of said threshold voltages is substantially determined by determining the total area of those parts of the floating and control gates which are laminated, and dividing that total area by a channel area, and where one of said enhancement type MOS transistors outputs a reference voltage; and a comparator, for comparing said reference voltage with a predetermined telephone battery voltage.

34. The reference voltage generation circuit according to claim 33, wherein a gate of one of said MOS transistors is connected to a drain of another of said MOS transistors, and said reference voltage is output from the connection between said enhancement type MOS transistors.

35. The reference voltage generation circuit, according to claim 33, wherein said reference voltage is output as a difference between said threshold voltages.

36. The reference voltage generation circuit according to claim 33, wherein said constant current source further comprises a gate, connected to a source of one of said depletion type MOS transistors.

37. The reference voltage generation circuit according to claim 33, wherein said enhancement type MOS transistors have substantially the same channel impurity profiles.

38. The reference voltage generation circuit according to any one of claims 33 to 37, wherein said control gate includes at least one cutting sections at an portion other than said channel, said cutting section being serially arranged.

39. The reference voltage generation circuit according to any one of claims 33 to 37, wherein said control gate includes at least one cutting section at an portion other than said channel, said cutting section being arranged in parallel.

40. The reference voltage generation circuit according to any one of claims 33 to 37, wherein said at least one cutting section is arranged on a portion of the laminates of the floating gate and the control gate other than a channel impurity region.

41. The reference voltage generation circuit according to any one of claims 33 to 37, wherein said at least one cutting section is arranged at a portion of the control gate where the floating gate is not laminated.

42. The reference voltage generation circuit according to any one of claims 33 to 37, wherein said at least one cutting section is arranged at a portion of the floating gate where the control gate is not laminated.

43. The reference voltage generation circuit according to claim 38, wherein said at least one cutting section includes a fuse circuit.

44. The reference voltage generation circuit according to claim 39, wherein said at least one cutting section includes a fuse circuit.

45. The reference voltage generation circuit according to claim 40, wherein said at least one cutting section includes a fuse circuit.

46. The reference voltage generation circuit according to claim 41, wherein said at least one cutting section includes a fuse circuit.

47. The method according to claim 15, wherein said step of determining further comprises:

laminating said floating and control gates only within said channel region.

48. The method according to claim 15, wherein said at least one fuse gates are arranged in serial or in parallel, or a combination of serial and parallel.

* * * * *